US006745871B2

(12) United States Patent
Armstrong

(10) Patent No.: US 6,745,871 B2
(45) Date of Patent: Jun. 8, 2004

(54) INTERLOCKING SCAFFOLD PLANK

(76) Inventor: Chad D. Armstrong, 5800 Griffiths La., Powell, OH (US) 43065

( * ) Notice: Subject to any disclaimer, the term of this patent is extended or adjusted under 35 U.S.C. 154(b) by 92 days.

(21) Appl. No.: 10/107,840

(22) Filed: Mar. 27, 2002

(65) Prior Publication Data

US 2003/0183453 A1 Oct. 2, 2003

(51) Int. Cl.[7] ..... E04G 1/16; E06C 7/16
(52) U.S. Cl. ..... 182/222; 182/119
(58) Field of Search ..... 182/119, 222, 182/223, 115–118, 131, 130, 123, 178.1, 179.1; 52/177, 588.1, 582.1; D25/68, 90; 108/51.1, 52.1, 56.1, 56.3, 144

(56) References Cited

U.S. PATENT DOCUMENTS

| | | | | | |
|---|---|---|---|---|---|
| 2,485,165 | A | * | 10/1949 | Pollman | 182/223 |
| 4,331,218 | A | | 5/1982 | Layher | |
| 4,445,590 | A | | 5/1984 | Ihrman | |
| 4,496,029 | A | | 1/1985 | Kuroda | |
| D281,106 | S | | 10/1985 | Thomas et al. | |
| 4,802,553 | A | | 2/1989 | Waters et al. | |
| 4,852,691 | A | * | 8/1989 | Bruno | 182/222 |
| 5,443,137 | A | * | 8/1995 | Wesler | 182/222 |
| 5,555,955 | A | | 9/1996 | D'Alessio | |
| 5,758,456 | A | * | 6/1998 | Case | 52/177 |
| 6,105,723 | A | | 8/2000 | D'Alessio | |
| 6,324,796 | B1 | * | 12/2001 | Heath | 52/177 |
| 6,431,316 | B1 | * | 8/2002 | Bothwell | 182/222 |
| 2001/0027899 | A1 | | 10/2001 | Bothwell | |

FOREIGN PATENT DOCUMENTS

| | | | | |
|---|---|---|---|---|
| DE | 10012685 | * | 10/2001 | 182/222 X |
| GB | 2234003 | * | 1/1991 | 182/222 |

OTHER PUBLICATIONS

Lynn Ladder & Scaffolding Co., Inc.; web page; Dec. 12, 2001; 2 pages.
Go–Front Scaffold; web page; Dec. 12, 2001; 2 pages.
Scaffold Service, Inc.; web page; Dec. 12, 2001; 2 pages.
Werner 5507–19 19–1/16×7' Aluminum Deck; web page; Dec. 12, 2001; 2 pages.

* cited by examiner

*Primary Examiner*—Hugh B. Thompson
(74) *Attorney, Agent, or Firm*—Jason H. Foster; Kremblas, Foster, Phillips & Pollick

(57) ABSTRACT

A composite scaffold plank for resting on two spaced, substantially parallel horizontal scaffold support members. The plank has an elongated planar panel with elongated reinforcing ribs mounted at a lateral edge substantially perpendicularly to the second major surface of the planar panel. The reinforcing ribs are substantially parallel and equally spaced from one another. There are notches defining tabs at each end of the planar panel that form a finger joint with another similar plank abutting the plank's end. Transverse channels formed in the ribs fit over the frame's horizontal support members.

8 Claims, 9 Drawing Sheets

INTERLOCKING SCAFFOLD PLANK

BACKGROUND OF THE INVENTION

1. Field of the Invention

This invention relates generally to construction structures, and more particularly to an improved scaffold plank that interlocks with other similar planks to provide a continuous scaffold platform surface.

2. Description of the Related Art

A well known alternative to ladders is a horizontal platform constructed above the ground to permit workers, such as painters, masons and carpenters, to work on the exterior or interior walls of a building. Conventionally, scaffolds, or a system of scaffolds, are made of a frame of metal tubes, bars or other beam members to form a lattice on which a plurality of planks rest. A common frame is made, for example, of one and one-half inch outer diameter tubes. The frame provides the vertical support for the planks, and the planks provide the platform upon which the workers can perform their labor without being concerned about balancing on, and continually moving, ladders. The advantages of scaffolding systems are manifest.

Conventional scaffolds have many disadvantages, however. For example, in scaffolds made of wooden planks there is a danger of breakage due to the heterogeneity of wood, and the difficulty of identifying weak areas. Additionally, wooden planks are typically overlapped at ends where they rest on the scaffold frame, in order to prevent a plank from slipping off of a supporting frame member. However, this overlap of a board that is almost two inches thick provides a dangerous trip hazard for the careless worker.

Some problems associated with wooden planks have been addressed by the prior art. For example, it is well known to construct an aluminum plank having I-beam shaped rails extending longitudinally along opposite lateral edges of an aluminum panel. These planks have hooks at opposite ends to extend over the beams of a scaffold frame. Various articles for attaching to the end of a wooden plank for hooking over scaffold frames attempt to simulate, at less cost, these aluminum planks.

All of the attempts of the prior art, however, tend to have problems in one of two areas. First, the hooking systems for planks commonly create gaps between adjacent ends of planks, through which a worker could step, causing injury. Second, planks with hooks are only supported at the hooks, rather than across the entire plank width, thereby creating a stress concentration near the hooks that could cause a failure.

There is a need for a scaffold plank that avoids the problems of the prior art, yet is affordable and safe.

(f) BRIEF SUMMARY OF THE INVENTION

The invention is a scaffold plank. The plank has an elongated planar panel with first and second opposing major surfaces. The first major surface is the surface that can be walked on by workers or upon which materials, such as bricks, can rest. The second major surface is the underside of the plank.

There are preferably at least four elongated reinforcement ribs mounted to the second major surface, which is the underside of the plank. The ribs have opposing first and second lateral rib edges, and each rib is mounted at its first lateral rib edge to the second major surface of the planar panel. Preferably, the ribs are substantially parallel to, and equally spaced from, each next adjacent rib.

First and third notches are formed in a first end of the panel. These notches form part of an interlocking, finger-type joint that will be made between longitudinally adjacent planks. The first and third notches extend longitudinally into the panel and into first and third reinforcement ribs. Second and fourth notches are formed in a second, opposite end of the panel and provide the same function as the first and third notches. The second and fourth notches extend longitudinally toward the first and third notches into the panel and into the second and fourth reinforcement ribs. The notches define tabs, the tabs being the regions of the planar panel adjacent each notch, and the tabs of one plank will be inserted into the notches of a longitudinally adjacent plank, for forming the interlocking finger-type joint.

First and third transverse channels are formed in the first and third reinforcement ribs, respectively. Each channel is formed in the respective rib's second lateral rib edge near the first end of the panel for forming a hook that will hook around a horizontal support member, such as a horizontal scaffold tube. Second and fourth transverse channels are formed in the second and fourth reinforcement ribs, respectively. Again, each channel is formed in the respective rib's second lateral rib edge near the second end of the panel. With this channel arrangement, the horizontal frame members rest in the channels when the plank is in its operable position. The channels keep the plank from moving horizontally.

(g) BRIEF DESCRIPTION OF THE SEVERAL VIEWS OF THE DRAWINGS

Figure 1:
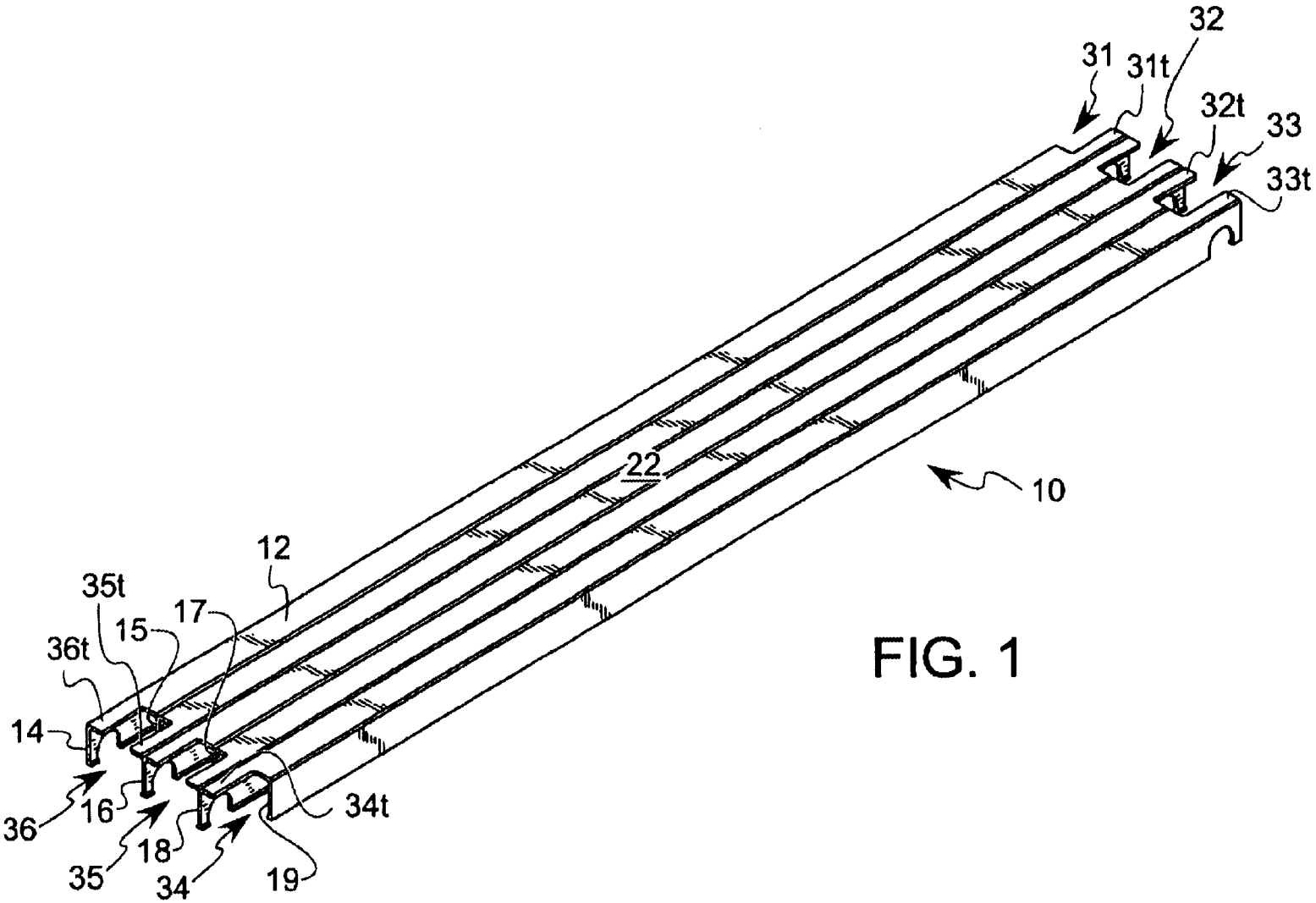
FIG. 1 is a view in perspective illustrating the top and ends of the preferred plank.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

(h) DETAILED DESCRIPTION OF THE INVENTION

Figure 2:
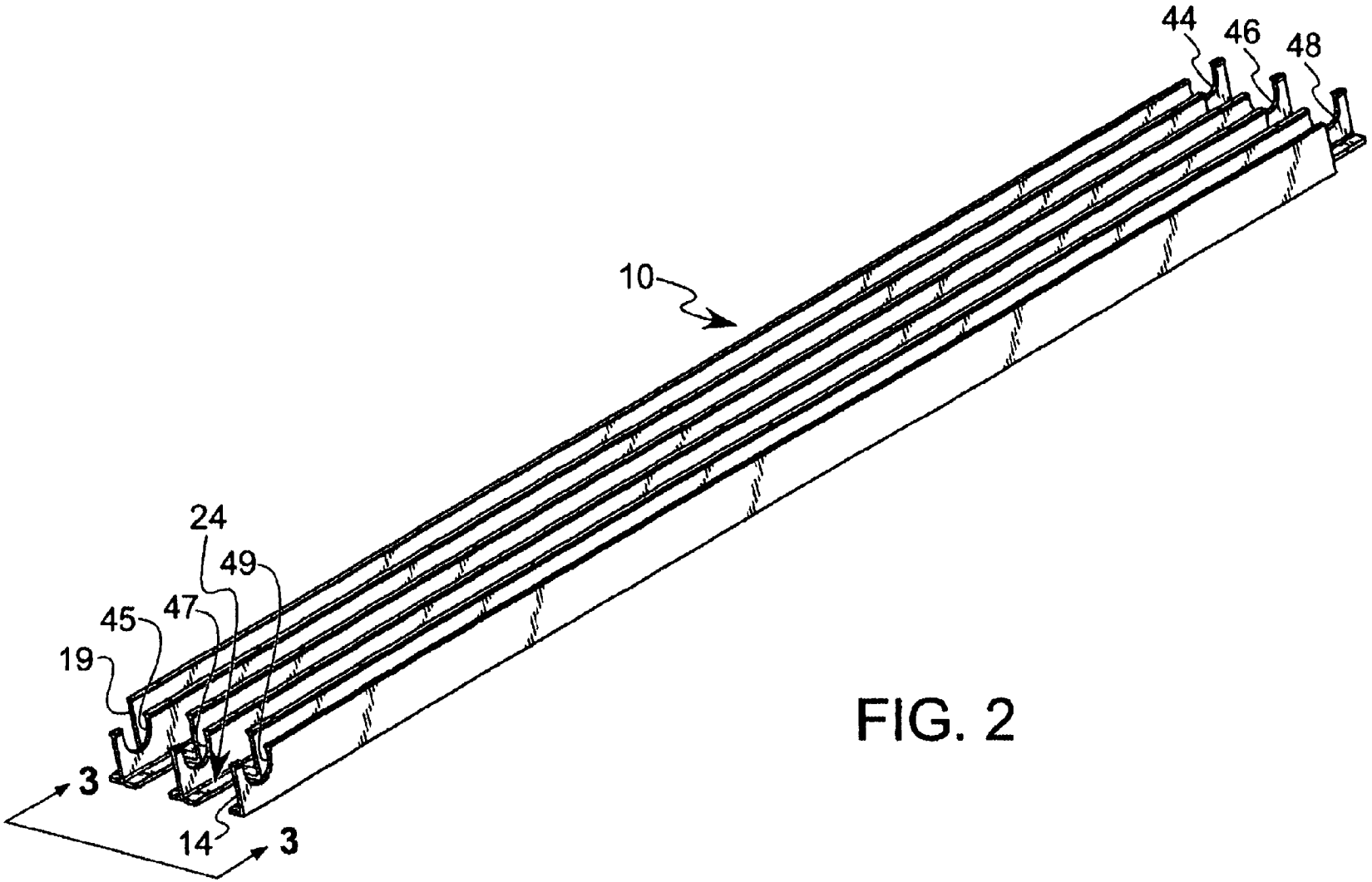
FIG. 2 is a view in perspective illustrating the bottom and ends of the preferred plank.
Figure 3:
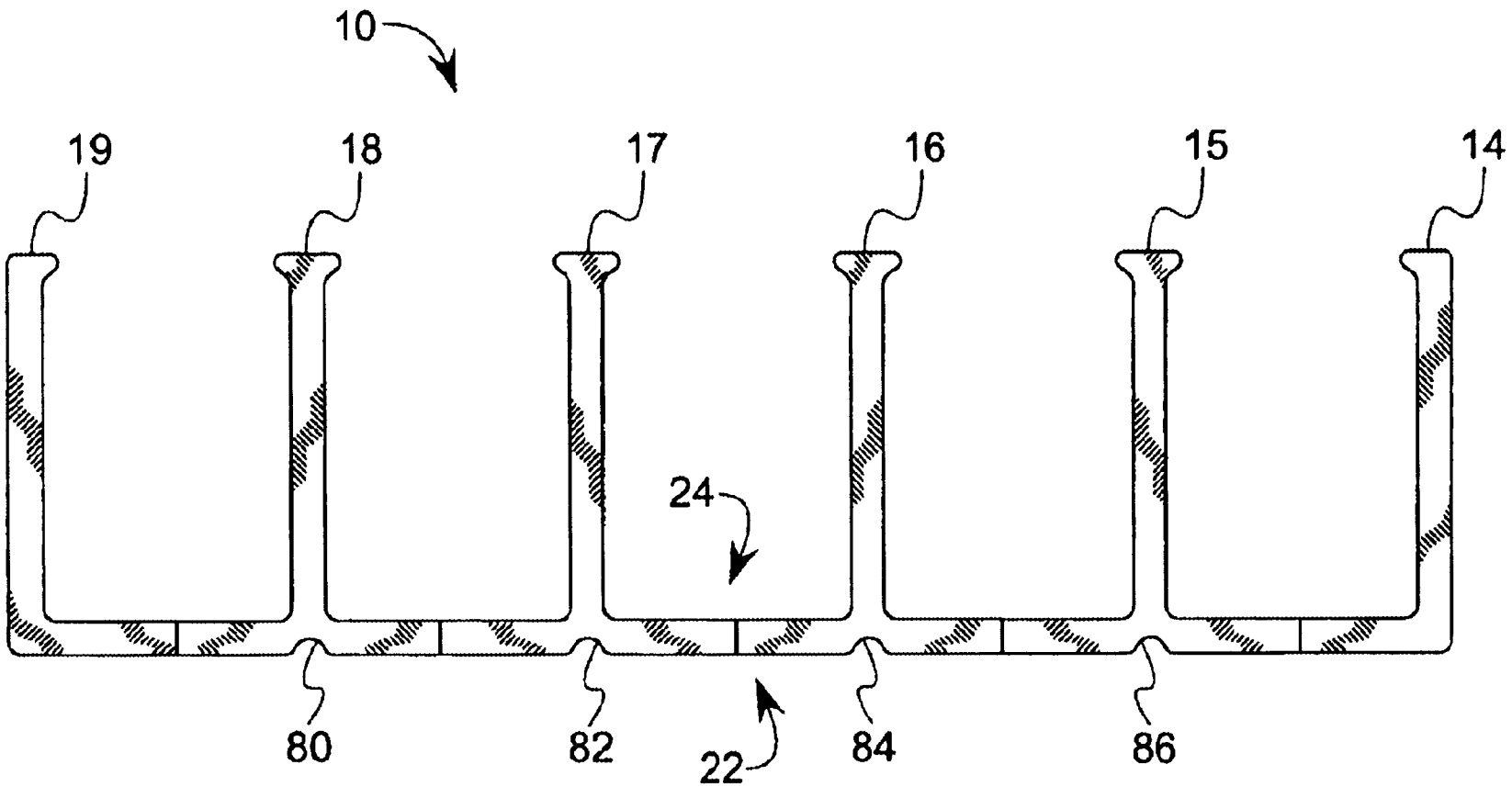
FIG. 3 is an end view illustrating the end of the preferred plank.

The preferred embodiment of the invention is shown in FIGS. 1, 2 and 3. The plank 10 has a planar panel 12 with opposing major surfaces 22 and 24 and six reinforcing ribs 14, 15, 16, 17, 18 and 19. The major surface 22 is the surface upon which workers will walk when the plank 20 is in its operable position, and upon which building materials can rest. The opposite major surface 24 is the underside of the plank 10 when the plank 10 is in its operable position. The planar panel has a thickness in an exemplary embodiment of approximately one-quarter inch. The ribs have a thickness in an exemplary embodiment of approximately one-quarter inch. The preferred overall dimensions of the plank 10 are seven feet, three inches in length, 11 inches in width and three inches in thickness. Of course, all of these dimensions could be changed, as will become apparent to the person of ordinary skill from the description of the invention, while still retaining the advantages of the present invention.

The ribs 14–19 are elongated plates with opposing lateral edges. Each rib is mounted at one of its lateral edges to the second major surface 24, which is the bottom of the plank 10 when, the plank 10 is in its operable position. The ribs 14–19 are specifically designed and oriented to impart substantial strength to the plank 10 to resist bending in its normal mode of operation, which is as a beam supported at opposite ends. Accordingly, the ribs have an I-beam shape, the plane of which is perpendicular to the plane of the panel 12. The I-beam shape provides significant structural reinforcement to the plank 10, thereby permitting the plank 10 to be used on conventional scaffolding systems in the place of conventional wooden planks. The preferred plank 10 is made of a mixture including polypropylene and short, natural fibers, such as kenaf fibers. The preferred plank 10 is made by extruding, although it could be pultruded if continuous fibers were used, or it could be cast or molded.

Figure 4:
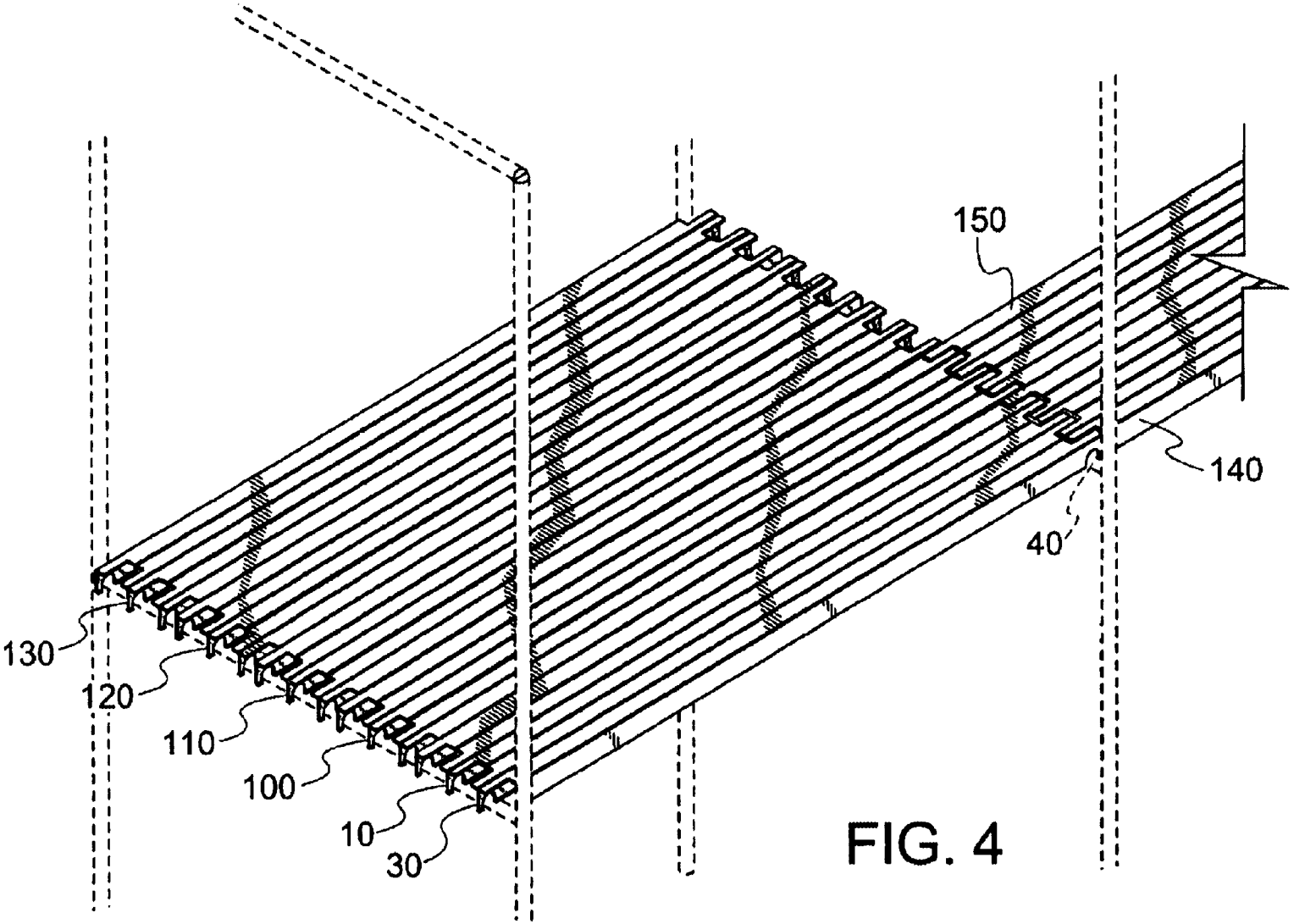
FIG. 4 is a view in perspective illustrating the preferred plank in an operable position on a frame with a plurality of other planks.
Figure 5:
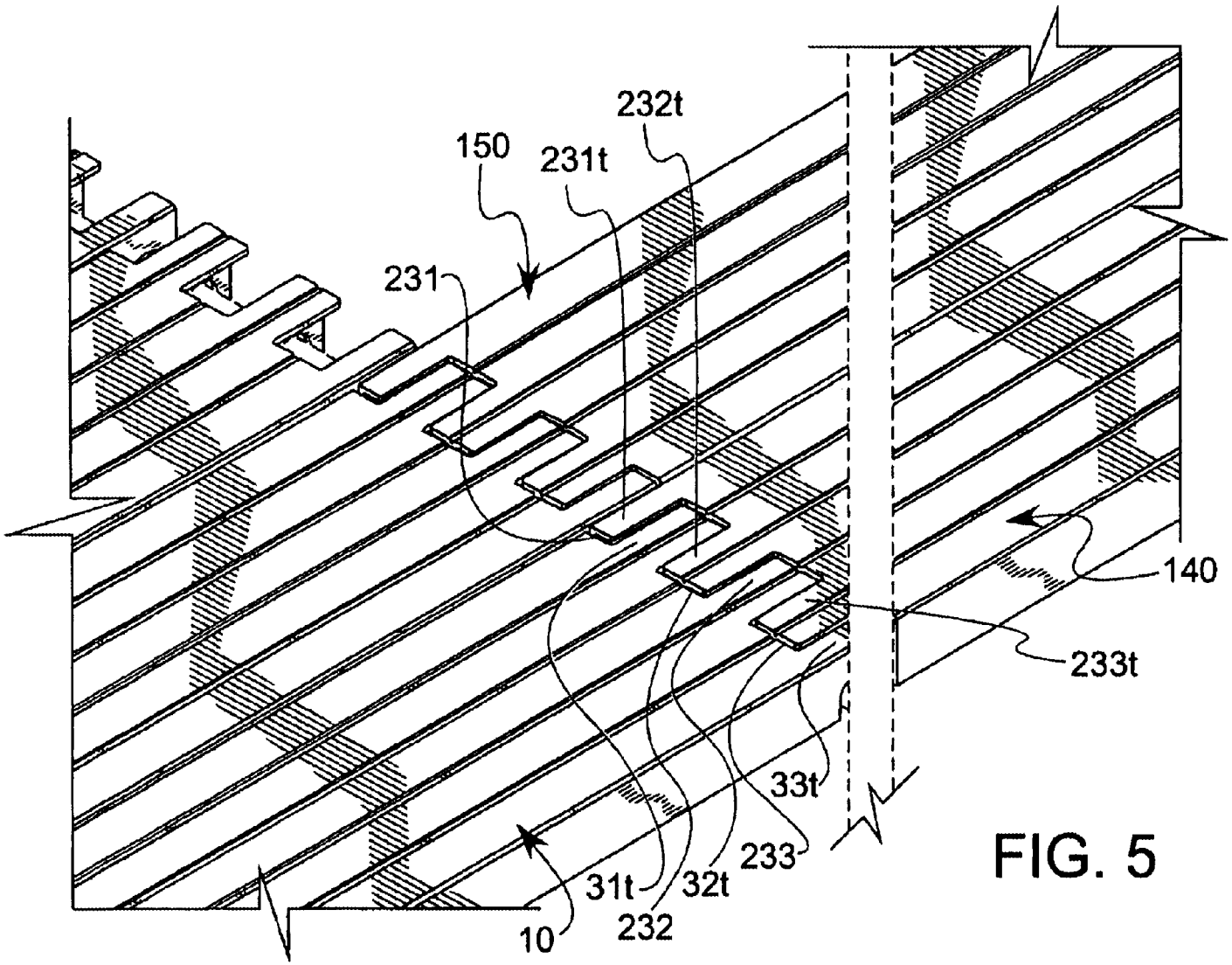
FIG. 5 is a view in perspective illustrating an enlarged region of the view of FIG. 4.
Figure 6:
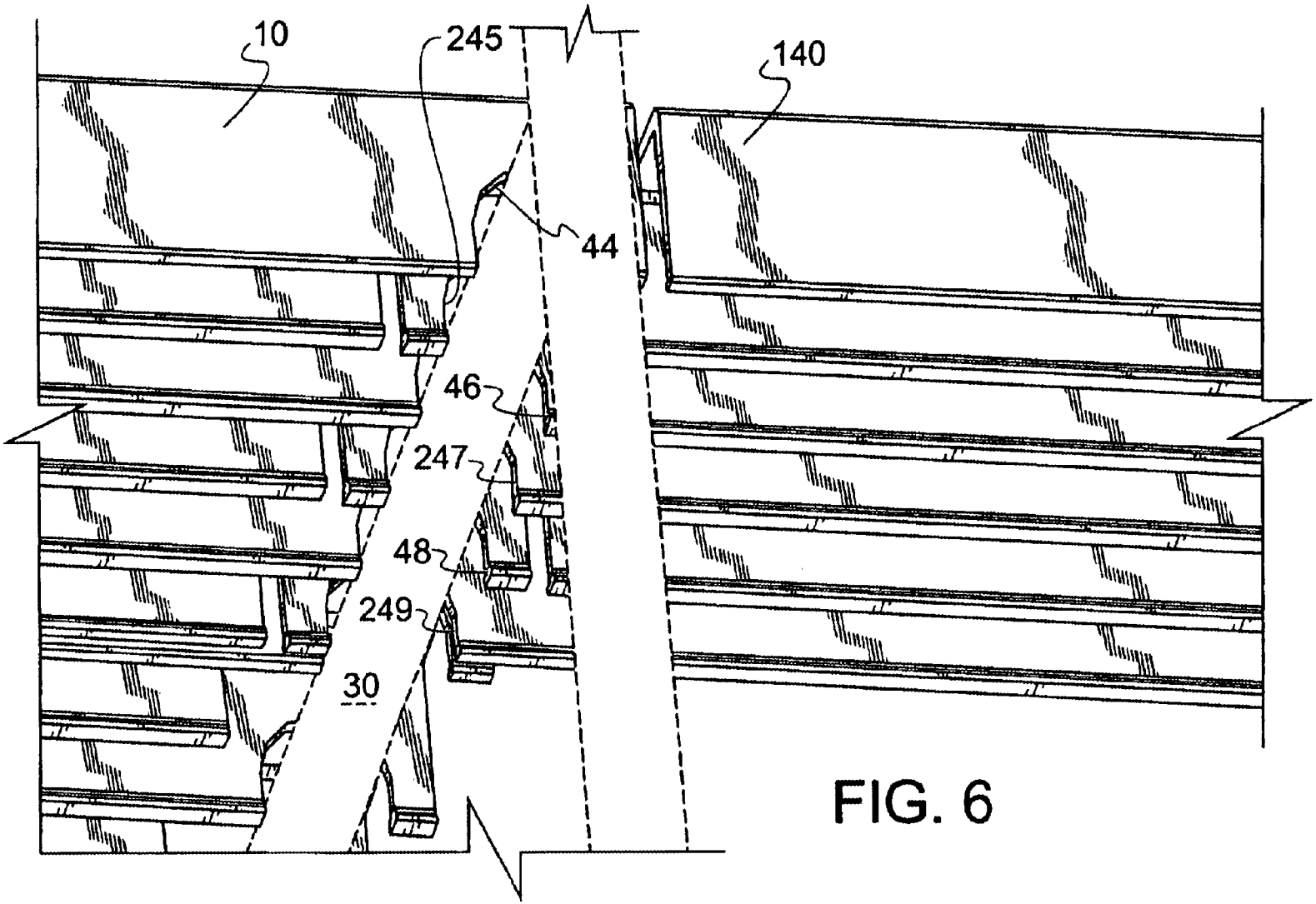
FIG. 6 is a view in perspective illustrating the underside of the preferred plank when mounted in an operable position on a frame with other similar planks.

The plank 10 is shown mounted on a conventional scaffolding frame in FIGS. 4, 5 and 6. The scaffolding frame has a pair of spaced horizontal frame members 30 and 40 upon which the invention is supported as described below. However, the remaining plank structures will be described first.

Figure 7:
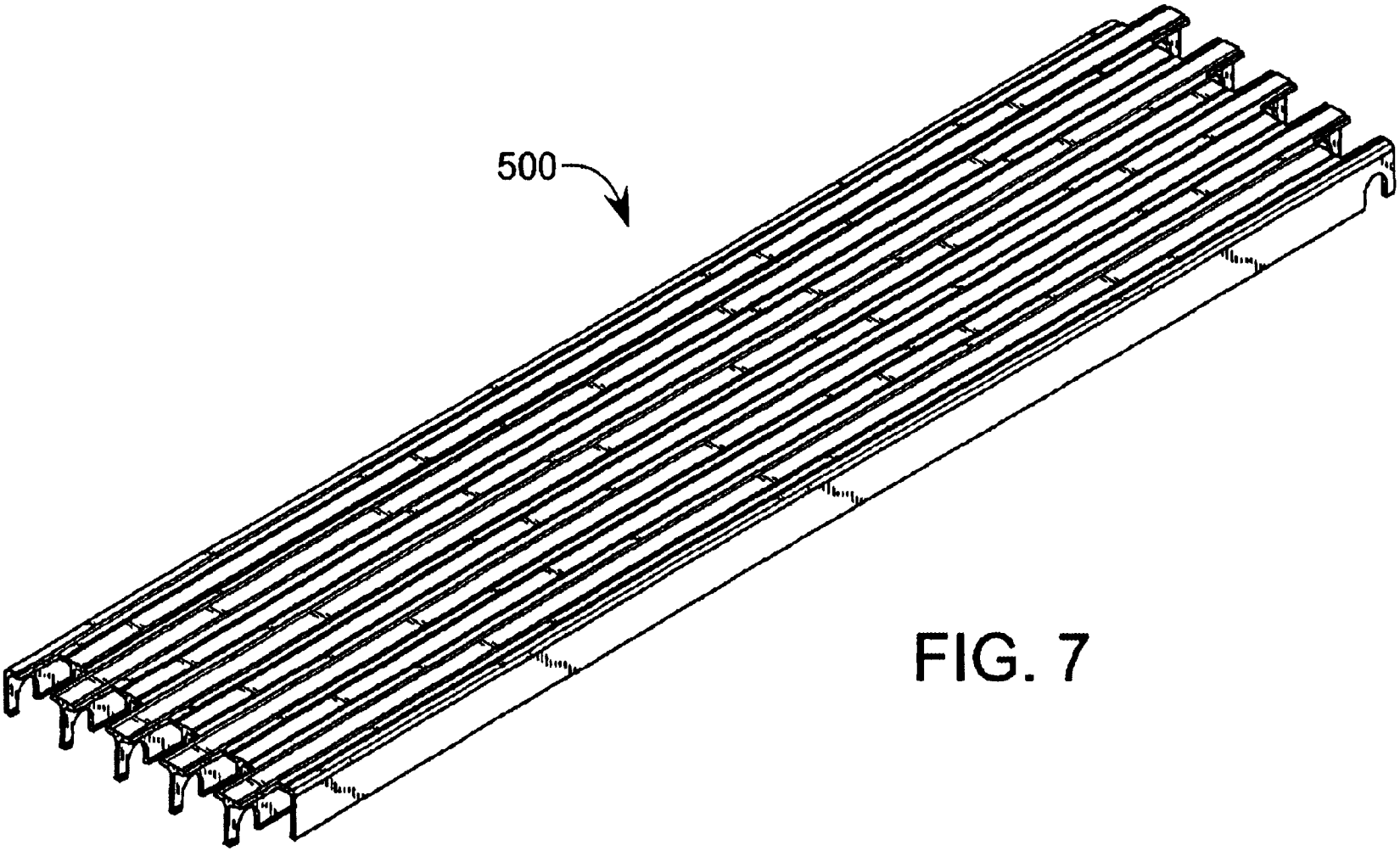
FIG. 7 is a view in perspective illustrating an alternative embodiment of the present invention.

The plank 10 has a number of features, at its ends in particular, that cause it to function in a way that provides significant advantages over the prior art. Six longitudinal notches 31, 32, 33, 34, 35 and 36 are formed in the opposite longitudinal ends of the planar panel 12. Of course, more than six notches can be formed, as shown by the plank 500 shown in FIG. 7, and fewer than six notches can be formed. In addition to being formed in the planar panel 12, the notches 31–36 extend longitudinally through the ends of every other rib at each end as is apparent from the figures. Thus, where the notches 31–36 are formed, a portion of the planar panel and the ribs is absent, either by removing material from a very long extruded plank that has been cut to length, or by forming the plank 10 as it is shown such as by molding. The notches are preferably about two and three-quarters inches long, and the notches 32, 33, 35 and 36 are about two and one-third inches wide. The notches 31 and 34 are approximately half as wide.

Between the notches the remaining portion of the planar panel 12 and the remaining ends of the reinforcing ribs form tabs. The tabs 31*t*, 32*t* and 33*t* are formed between adjacent the notches 31, 32 and 33, respectively. The tabs 34*t*, 35*t* and 36*t* are formed adjacent the notches 34, 35 and 36, respectively, at the opposite plank end. The tabs are approximately two and one-half inches long (one-quarter inch shorter than the notches) and the tabs 34*t* and 35*t* are approximately 1.833 inches wide. The tab 36*t* is approximately half as wide. The tabs at the opposite end of the plank 10 are the same dimensions as the corresponding tabs 34*t*, 35*t* and 36*t*.

In addition to the notches 31–36 and the tabs 31*t*–36*t*, there are transverse channels 44, 45, 46, 47, 48 and 49 (see FIG. 2) formed on the lateral edges of the ribs 14–19 that are opposite the lateral edge mounted to the second major surface 24 of the planar panel 12. The transverse channels 44–49 are preferably semi-circular at their deepest points and the channels 44–49 are aligned along an axis that is perpendicular to the ribs 14–19, thereby permitting the horizontal support members 30 and 40, which are circular, to be positioned in the aligned channels. The channels are preferably formed starting about 0.65 inches from the end of the plank 10, they are about two inches wide, and the radius of the semi-circular region of the channels is about one inch. These dimensions are to accommodate the common one and one-half inch tubes of scaffold frames, but can be changed as will be apparent to one of ordinary skill.

As is shown in FIG. 4, the plank 10 is placed in its operable position on the scaffold frame with the horizontal support members 30 and 40 in the channels 44–49. The horizontal support members 30 and 40 support the ends of the plank 10 against horizontal and downward components of force, and therefore the plank 10 can be walked on, or building materials or other objects can be placed on the plank 10 without displacing the plank 10. Additionally, other planks, such as the planks 100, 110, 120 and 130, can be placed on the horizontal support members 30 and 40 parallel to, and beside, one another. The cooperation of the upper surfaces of the planks forms a larger planar surface upon which workers can walk and stack materials and tools.

In addition to the planks 100–130 positioned laterally beside the plank 10, the planks 140 and 150 are positioned longitudinally end-to-end relative to the plank 10, thereby lengthening the work surface. Looking to FIGS. 5 and 6, it will be appreciated that there are notches 231, 232 and 233 formed in the end of the plank 140 that are identical to the notches 34, 35 and 36 formed in the end of the plank 10 and shown in FIG. 1. Between these notches 231–233 are tabs 231*t*, 232*t* and 233*t*. The tabs 231*t*–233*t* are identical to the tabs 34*t*–36*t*, respectively on the end of the plank 10.

The tabs 231*t*–233*t* of the plank 140 are positioned within, and in close proximity to the edges of, the notches 31, 32 and 33, respectively, of the plank 10. Likewise, the tabs 31*t*–33*t* of the plank 10 are positioned within, and in close proximity to the edges of, the notches 231–233, respectively, of the plank 140. This relative positioning provides an upper work surface that is continuous between planks, which means that adjacent planks have upper surfaces that are coplanar, and that there are no significant gaps between longitudinally adjacent planks. The presence of significant gaps between laterally adjacent planks is determined by whether the sides of each plank abuts the laterally adjacent planks. Gaps of about one-quarter inch or less are not significant.

There are no significant gaps between longitudinally adjacent planks of the present invention due to alignment of the channels 44, 46 and 48 of the plank 10, and adjacent channels 245, 247 and 249 of the plank 140. The channels align when the planks 10 and 140 are placed over the horizontal support member 30. When the planks 10 and 140 are mounted with their respective channels aligned as shown in FIG. 6, the tabs and notches also align as shown in FIG. 5. The gaps formed between the adjacent tabs of longitudinally adjacent planks are about one-quarter inch. By aligning the planks and their respective tabs, channels and notches, an interlocking finger-type joint is formed at each abutting end.

Each reinforcing rib supports the planar panel 12 along the length of the rib, and each rib functions as a beam in typical bending stress between the horizontal support members when the plank is under normal load. At one end of each rib there is a channel formed, as described above, to hook over a horizontal scaffolding frame member. However, at the opposite end of each reinforcing rib from its channel, there is no channel formed. Thus, at one end of the plank 10, every other reinforcing rib, such as the reinforcing ribs 14, 16 and 18, have channels, such as channels 45, 47 and 49, respectively. At the opposite end of the plank 10, the channels 44, 46 and 48 are formed in the reinforcing ribs 19, 17 and 15, respectively, which are the reinforcing ribs without channels in their opposite ends. By forming channels in every other reinforcing rib at each end of the plank, and by resting every other rib on the scaffold frame at each end of the plank 10, the planar panel 12 forming a work surface is supported directly by the horizontal support member upon which the plank 10 rests. Thus, there are only very small spaces, no greater than twice the space between reinforcing ribs, between adjacent regions of the planar panel 12 that are supported directly by the scaffold's horizontal support member. This prevents concentrations of stress that are common in the prior art.

It will be appreciated that the present invention is a lightweight and strong composite material that is not conductive, and will not corrode or rot as prior art planks will. Furthermore, by aligning the present planks laterally and longitudinally adjacent to one another, a construction worker can easily construct a platform that is strong, has no large areas that are unsupported, and has an upper surface that has no significant gaps or trip hazards. Additionally, the plank 10 has storage space saving advantages, inasmuch as the reinforcing ribs of a plank like the plank 10 can be nested within the spaces between the ribs of another similar plank. This permits two planks to be stored in the space only slightly larger than a single plank.

In a preferred embodiment, the first major surface of the planar panel 12, which is the surface upon which workers walk and/or rest materials, has a liquid-channeling, slip-resistant configuration. Turning to FIG. 3, the elongated grooves 80, 82, 84 and 86 are formed in the major surface 22 of the planar panel 12. These grooves 80–86 are the lowest point on a level, operably mounted plank, and therefore the grooves 80–86 channel any liquid, such as water or oil, away from the surface of the plank 10 that is worked on. Thus the grooves 80–86 improve the safety of the workers, by avoiding the pooling of water and ice on the plank 10.

Figure 8:
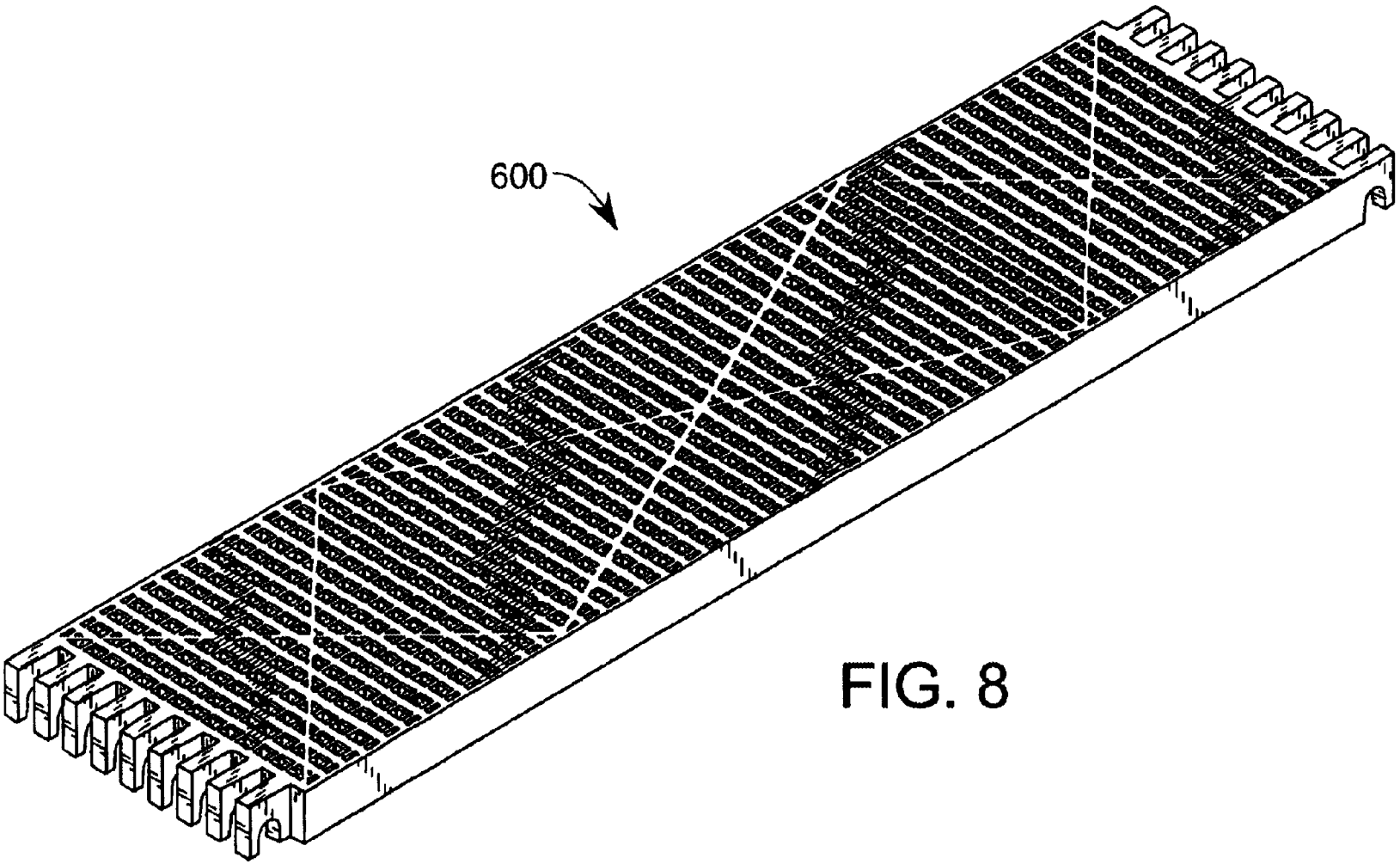
FIG. 8 is a view in perspective illustrating an alternative embodiment of the present invention.
Figure 9:
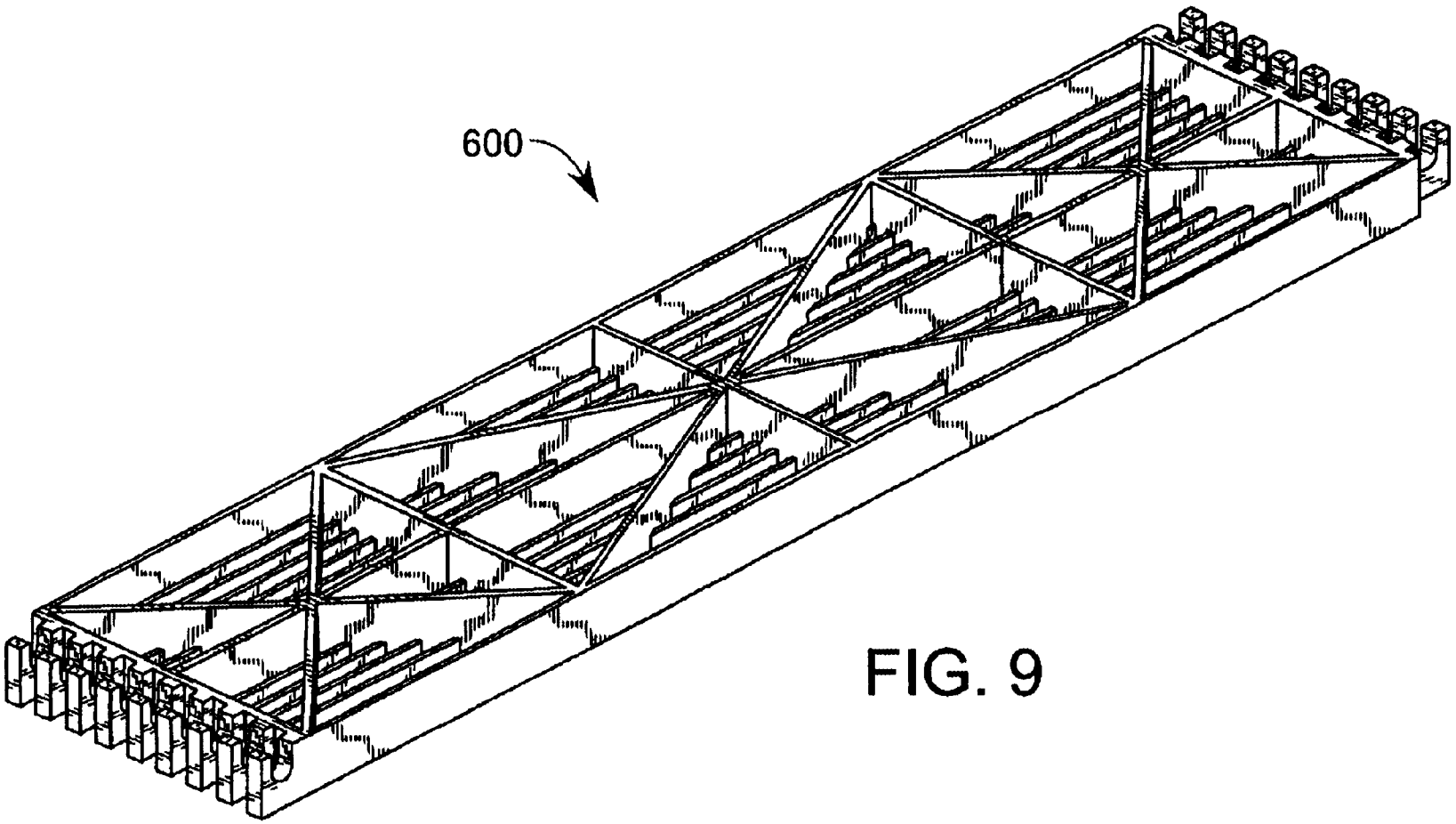
FIG. 9 is a view in perspective illustrating an alternative embodiment of the present invention.

In an alternative embodiment of the invention shown in FIGS. 8 and 9, the plank 600 is of a configuration that is molded or cast.

While certain preferred embodiments of the present invention have been disclosed in detail, it is to be understood that various modifications may be adopted without departing from the spirit of the invention or scope of the following claims.

What is claimed is:

1. A scaffold plank comprising:

(a) an elongated planar panel having first and second opposing major surfaces;

(b) first, second, third and fourth elongated reinforcement ribs having opposing first and second lateral rib edges, each of said ribs being mounted at its respective first lateral rib edge to the second major surface of said planar panel;

(c) at least one transverse channel formed in the second lateral rib edge of one of said reinforcement ribs near a longitudinal rib end;

(d) first and third notches formed in a first end of said panel, said first and third notches extending longitudinally into the panel and into the respective first and third reinforcement ribs; and (e) second and fourth notches formed in a second, opposite end of said panel, said second and fourth notches extending longitudinally into the panel and into the respective second and fourth reinforcement ribs toward the first and third notches.

2. The scaffold plank in accordance with claim 1, wherein said at least one transverse channel comprises:

(a) first and third transverse channels formed in the first and third reinforcement ribs, respectively, each channel being formed in the respective rib's second lateral rib edge near the first end of the panel; and (b) second and fourth transverse channels formed in the second and fourth reinforcement ribs, respectively, each channel being formed in the respective rib's second lateral rib edge near the second end of the panel.

3. The scaffold plank in accordance with claim 2, further comprising first, second, third and fourth tabs extending from the planar panel adjacent the first, second, third and fourth notches, respectively.

4. The scaffold plank in accordance with claim 3, wherein said reinforcement ribs are substantially parallel to one another, and substantially equally spaced from each next adjacent rib.

5. A scaffold plank comprising:

(a) an elongated planar panel having first and second opposing major surfaces;

(b) at least first, second, third and fourth elongated reinforcement ribs having opposing first and second lateral rib edges, each of said ribs being mounted at the first lateral rib edge to the second major surface of said planar panel substantially parallel to and equally spaced from each next adjacent rib;

(c) first and third notches formed in a first end of said panel, said first and third notches extending longitudinally into the panel and into the respective first and third reinforcement ribs;

(d) second and fourth notches formed in a second, opposite end of said panel, said second and fourth notches extending longitudinally into the panel and into the respective second and fourth reinforcement ribs toward the first and third notches;

(e) first and third transverse channels formed in the first and third reinforcement ribs, respectively, each of said channels being formed in the respective rib's second lateral rib edge near the first end of the panel; and (f) second and fourth transverse channels formed in the second and fourth reinforcement ribs, respectively, each of said second and fourth channels being formed in the respective rib's second lateral rib edge near the second end of the panel.

6. The scaffold plank in accordance with claim 5, further comprising first, second, third and fourth tabs extending from the planar panel adjacent the first, second, third and fourth notches, respectively.

7. The scaffold plank in accordance with claim 6, wherein said reinforcement ribs are substantially parallel to one another.

8. The scaffold plank in accordance with claim 7, wherein the plank is a composite.

* * * * *